United States Patent [19]

Shattuck

[11] 4,022,993

[45] May 10, 1977

[54] SWITCH ASSEMBLY HAVING ELECTRICALLY ILLUMINATED CHARACTER DISPLAY DEVICES BETWEEN TRANSPARENT ACTUATORS AND SWITCH ARRAYS

[75] Inventor: Ronald Corroalles Shattuck, Canoga Park, Calif.

[73] Assignee: Litton Systems, Inc., Beverly Hills, Calif.

[22] Filed: June 9, 1975

[21] Appl. No.: 585,203

[52] U.S. Cl. ..... 200/5 A; 200/159 B; 200/313; 200/314; 200/340

[51] Int. Cl.[2] ..... H01H 9/00; H01H 13/70

[58] Field of Search ..... 200/5 R, 5 A, 159 B, 200/302, 308, 317, 315, 340, 310–314, 316; 340/365 R, 365 A, 365 C, 365 L; 313/500, 505, 510, 511, 512

[56] References Cited

UNITED STATES PATENTS

| | | | |
|---|---|---|---|
| 3,591,749 | 7/1971 | Comstock | 200/308 |
| 3,617,660 | 11/1971 | Krakinowski | 200/159 B X |
| 3,732,389 | 5/1973 | Kaelin et al. | 200/5 A X |
| 3,742,157 | 6/1973 | Leposavic | 200/159 B X |
| 3,786,307 | 1/1974 | Robinson | 313/505 X |
| 3,808,384 | 4/1974 | Boulanger | 200/159 B X |
| 3,811,025 | 5/1974 | Bach | 200/5 A X |
| 3,856,998 | 12/1974 | Sims, Jr. | 200/159 B X |
| 3,860,771 | 1/1975 | Lynn et al. | 200/159 B X |
| 3,976,906 | 8/1976 | Shattuck | 313/500 |

*Primary Examiner*—James R. Scott
*Attorney, Agent, or Firm*—Donald J. Ellingsberg

[57] ABSTRACT

A switch assembly having a lighted display module for programmable character display where the module is an active part during switch actuation since the module is displaced by and transmits an applied switch actuating force. The switch assembly consists of electromechanical switch arrays having the illuminated solid-state programming character display (LED-type) disposed above the switch array. Transparent pushbuttons are illuminated when depressed. The electromechanical switch arrays consist of a matrix of conventional dome switches although other conventional types of switches may be used.

6 Claims, 5 Drawing Figures

Fig. 5
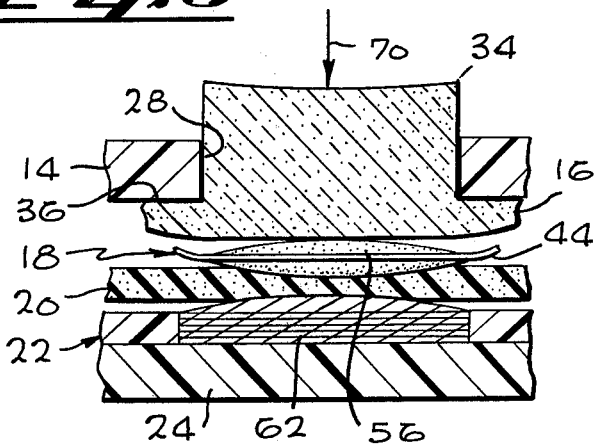
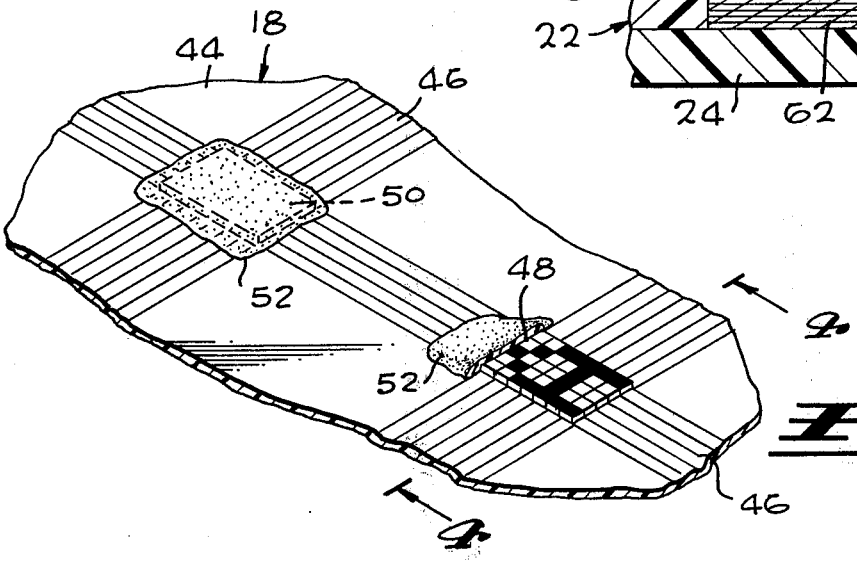
Fig. 3
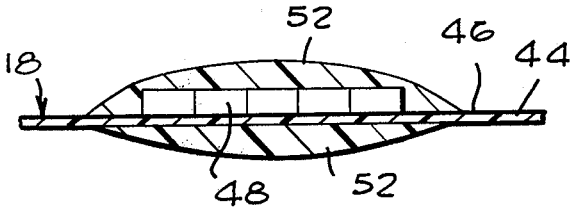
Fig. 4

SWITCH ASSEMBLY HAVING ELECTRICALLY ILLUMINATED CHARACTER DISPLAY DEVICES BETWEEN TRANSPARENT ACTUATORS AND SWITCH ARRAYS

BACKGROUND OF THE INVENTION

Illuminated switch assemblies of various types are considered to be well known in the prior art. Among the various types are those switch assemblies that either project indicia from a plane behind the switch to the switch panel or from the plane behind the switch through the actual switch itself for viewing at the switch/switch panel assembly. U.S. Pat. No. 3,777,222 is considered to be one example of an indicating panel including a switch assembly that incorporates both principles of rear projection and through-the-switch illumination. However, where it is desired to use other than a membrane type switch (U.S. Pat. No. 3,732,389 is one example thereof) with the principle of through-the-switch illumination, the problem, which is solved by the present invention, becomes readily apparent.

OBJECTS OF THE INVENTION

Accordingly, it is an object of the invention to provide a new and improved switch assembly.

It is an object of the invention to provide a switch assembly for illumination of displaceable indicia during switch actuation by the indicia.

It is an object of the invention to provide a switch assembly for illumination of programmable and displaceable indicia during switch actuation.

It is an object of the invention to provide a switch assembly for illumination of displaceable indicia that minimizes damage to the displaceable indicia during switch actuation by the indicia.

SUMMARY OF THE INVENTION

Briefly, in accordance with the invention, a new and improved switch assembly is provided having a transparent force transmitting means such as a flexible keypad with transparent keys that, when a selected key is displaced by an actuating force, itself displaces a flexible indicator means, which displays indicia through the displaced key and where the indicia can be programmable, to operate a switch means through an intermediate resilient means that absorbs a portion of the actuating force and any rebound force developed by the switch means during its operation — both to substantially minimize any loss of integrity of the flexible indicator means.

While the specification concludes with claims particularly pointing out and distinctly claiming the subject matter which may be regarded as the invention, the organization and method of operation, together with further objects, features, and the attending advantages thereof, may best be understood when the following description is read in connection with the accompanying drawing.

BRIEF DESCRIPTION OF THE DRAWING

FIG. 3 is a perspective view, partly broken away, of the flexible indicator layer of the switch assembly of the switch assembly of FIG. 2.

FIG. 4 is a sectional view of the flexible indicator layer along the line 4—4 of FIG. 3.

FIG. 5 is a sectional view, partly broken away, of the switch assembly of FIG. 2 during actuation thereof.

DESCRIPTION OF THE INVENTION

Figure 1:
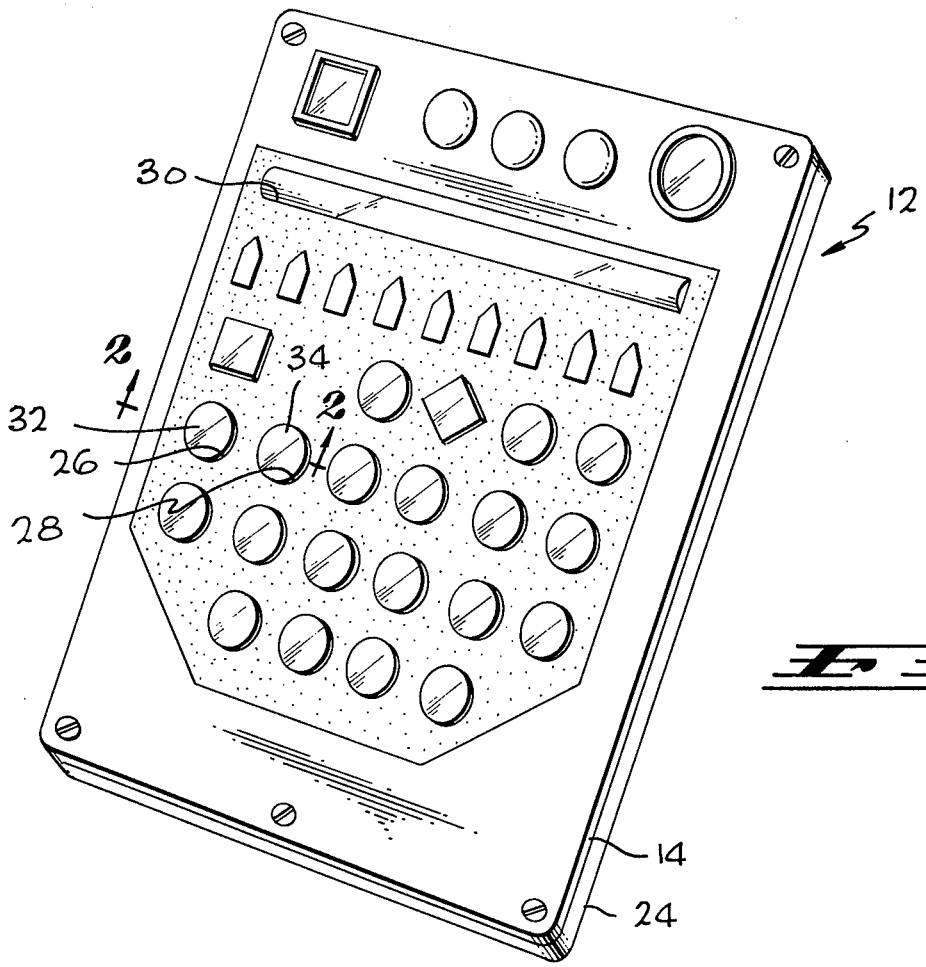
FIG. 1 is a perspective view of the switch assembly of the invention in an operative unit.
Figure 2:
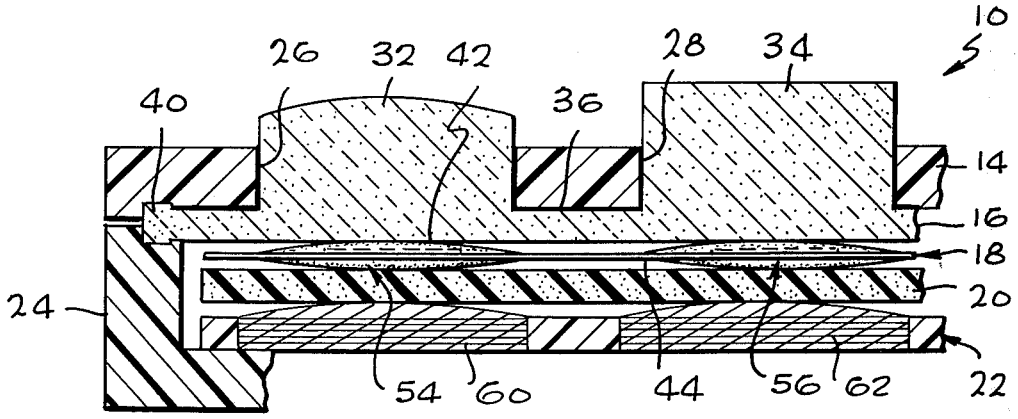
FIG. 2 is an enlarged, sectional view of the switch assembly along the line 2—2 of FIG. 1.

Referring to FIGS. 1 and 2, the switch assembly 10 of the invention can find use in a portable interactive device 12 which can be a hand-held computer with display. However, it is contemplated that the switch assembly can find use wherever there is a need for both an illuminated, programmable indicator and a control switch as an integral assembly.

In FIG. 2, the switch assembly 10 includes several elements: a switch panel 14, a keypad 16, an indicator package 18, a cushion 20, a switch package 22, and a case or housing 24.

The switch panel 14 and the keypad 16 coact as a unit in the switch assembly.

The switch panel 14, which is the cover for the case 24, is formed from a firm material with a plurality of selectively positioned apertures; for example, key apertures 26 and 28 (see FIG. 2) and display aperture 30 (see FIG. 1). Both the key apertures and the display apertures can be formed to a desired geometry so that various key and display areas are provided.

The keypad 16 is formed from a transparent, flexible, and readily moldable material which can be a conventional elastomer. Keycaps, such as keycaps 32 and 34, are molded at selected positions so that the respective keycaps, for example keycaps 32 and 34, extend outwardly through an associated key aperture, here key apertures 26 and 28. When thus positioned, the keypad 16 is preferably bonded at boundary line 36 to the switch panel 14.

The perimeter of the keypad 16 can be formed into a perimeter bead portion 40 that acts as an effective seal between the switch panel 14 and the case 24 as illustrated by FIG. 2. The perimeter seal 40 can be used to exclude foreign matter from entering the switch assembly 10, or to develop a hermetic seal, or the like.

The keypad 16 can be either a clear, transparent member or a colored, transparent member. For example, various transparent color dyes can be used for color coding of selected keypad areas such as selected keycaps, or for optical control enhancement, or both. Keycap extenders (not shown) can also be used with the keypad 16; and, selected nomenclature or indicia can be molded into individual keycaps, filled with a suitable opaque material, fused, and cured in situ. It is contemplated that optical contrast can also be enhanced by applying various color, optical materials, or light masks on the inner surface 42 of keypad 16 at a selected keycap, such as keycap 32.

It is also contemplated that the keypad 16 can be edge lighted which may be desirable (1) in low ambient light environments, (2) to attract an operator's attention when flashed, and/or (3) to direct the operator to a specific portion of the switch panel 14.

The indicator package 18, shown in U.S. Pat. No. 3,976,906 of FIGS. 2, 3 and 4 has a base plate 44 that is relatively thin and flexible. Desired electrical circuitry 46, which can be a plurality of similar electrical conductor strips oriented along both an x-axis and a y-axis of the base plate. Light emitting devices, such as light emitting devices 48 and 50, are positioned at selected locations on the base plate 44. When the light emitting devices are a 5 × 7 array of light emitting diodes (LED) as illustrated by FIGS. 3 and 4, the LED devices 48 and 50 are electrically connected to the appropriate x- and y-axes intersections so that the LED devices function as readily programmable character display devices. Each of the LED devices 48 and 50 are encapsulated in a transparent epoxy 52 that, when suitably cured, form a hard protective module such as modules 54 and 56 as illustrated by FIG. 2. It is contemplated that other light emitting devices, which may or may not be programmable, can also be used in the encapsulated modules and/or at other base plate areas such as those common to selected display apertures.

The cushion 20 as shown by FIG. 2 is selected to have a desired resiliency for the absorption of a portion of an operator induced force and for the dissipation of forces induced by other than an operator as described hereinafter.

A conventional dome switch package 22 completes the switch assembly 10. In FIG. 2, the switch package has a dome switch 60 coactive with keycap 32 and programmable character display module 54, and a dome switch 62 coactive with keycap 34 and display module 56.

Operatively, the switch assembly 10 is actuated by an applied actuating force, schematically depicted by force arrow 70 in FIG. 5, which displaces keycap 34 from its non-actuating or rest position as illustrated by FIG. 2 and flexes the keypad 16 (exaggerated in FIG. 5 for clarity and understanding). Since the encapsulated display module 56 is hard, the displaced keycap 34 transmits the actuating force to the module and displaces it while at the same time flexing the base plate 44 thereof. The displaced module 56 compresses the adjacent resilient cushion 20 which absorbs a portion of the thus transmitted actuating force. The remainder of the actuating force is transmitted by the cushion 20 which depresses the dome switch 62 into its actuate mode. The resiliency of the cushion 20 combined with the flexure both of base plate 44 and of keypad 16, including the slight compressibility of keycap 34, restores the switch assembly 10 to its non-actuating or rest position when the actuating force 70 is removed. Any "snap-back" force generated by the dome switch 62 when the actuating force is removed is absorbed and dissipated by the resilient cushion 20 so that damage to the display module 56 is avoided. Similarly, the resiliency of not only the cushion 20 but also the springiness of the material that forms the keypad 16 and its keycaps also prevents damage to the display module 56 during switch assembly actuation.

As will be evidenced from the foregoing description, certain aspects of the invention are not limited to the particular details of construction as illustrated, and it is contemplated that other modifications and applications will occur to those skilled in the art. It is, therefore, intended that the appended claims shall cover such modifications and applications that do not depart from the true spirit and scope of the invention.

I claim:

1. A keyboard assembly, comprising:

an array of electromechanical switches;

a thin flexible base plate adjacent the array of switches capable of transmitting actuating force to the switches;

a resilient cushion mounted between the flexible base plate and the array of switches for absorbing a portion of the actuating force applied to the devices and for dissipation of snap back forces from the switches; and an array of electrically programmable illuminated character display devices positioned at selected locations on the base plate to correspond to the locations of individual switches in the electromechanical switch array.

2. The keyboard assembly as claimed in claim 1, further comprising:

a transparent flexible keypad mounted adjacent the base plate opposite the switch array for transmitting the actuating force to the flexible base plate.

3. The keyboard assembly as claimed in claim 2, further comprising:

transparent key caps positioned at selected locations on the keypad to correspond to the locations of the display devices on the flexible base plate.

4. The keyboard assembly as claimed in claim 2, further comprising:

an open sided housing having the switch array, flexible base plate, and keypad positioned therein, the keypad covering the open side; and a rigid switch panel adjacent the keypad and forming a seal therewith around the perimeter of the open side of the housing, the switch panel including transparent actuating force transmitting means positioned at selected locations on the switch panel to correspond to the locations of the display devices on the flexible base plate.

5. The keyboard assembly as claimed in claim 4 wherein the transparent actuating force transmitting means are apertures in the switch panel.

6. The keyboard assembly as claimed in claim 4, further comprising:

transparent keycaps positioned at selected locations on the keypad to correspond to the locations of the display devices on the flexible base plate and extending through the apertures in the switch panel.

* * * * *